US006107533A

United States Patent [19]

Vebeliunas et al.

[11] Patent Number: 6,107,533

[45] **Date of Patent: *Aug. 22, 2000**

[54] FOULANT REDUCING UPSTREAM HYDROGENATION UNIT SYSTEMS

[75] Inventors: Rimas Virgilijus Vebeliunas; David Alan Bamford, both of Houston, Tex.; Neil James Drummond, Dunfermline, United Kingdom; Sheri Renee Snider; Robert David Strack, both of Houston, Tex.; Roy Thomas Halle, League City, Tex.

[73] Assignee: Exxon Chemical Patents Inc., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/871,859

[22] Filed: Jun. 9, 1997

Related U.S. Application Data

[63] Continuation of application No. 08/296,767, Aug. 26, 1994, abandoned.

[51] Int. Cl.[7] ..... C07C 5/03; C07C 5/08; C07C 5/09; C07C 7/04

[52] U.S. Cl. ..... 585/259; 585/264; 585/809; 585/950; 208/92; 208/48 R

[58] Field of Search ..... 585/809, 259, 585/264, 950; 208/92, 48 R

[56] References Cited

U.S. PATENT DOCUMENTS

| | | | |
|---|---|---|---|
| 3,537,982 | 11/1970 | Parker . | |
| 5,090,977 | 2/1992 | Strock et al. . | |
| 5,220,097 | 6/1993 | Lam et al. | 585/809 |

FOREIGN PATENT DOCUMENTS

| | | |
|---|---|---|
| 935717 | 4/1963 | United Kingdom . |

*Primary Examiner*—Elizabeth D Wood
*Attorney, Agent, or Firm*—James A. Zboray

[57] ABSTRACT

Process flow sequences for the reduction of equipment fouling in the fractional distillation of light end hydrocarbon components, such as those produced by pyrolysis or steam cracking, wherein conventional multiple hydrogenation unit configurations are replaced with upstream hydrogenation unit configurations. The upstream hydrogenation units of the invention are located at either side draws or in the reboiler circuit of deethanizers, in front-end demethanizer and front-end deethanizer sequences, or depropanizers, in front-end depropanizer sequences and obviate the need for most of the conventionally used hydrogenation units downstream.

18 Claims, 4 Drawing Sheets

FOULANT REDUCING UPSTREAM HYDROGENATION UNIT SYSTEMS

This is a continuation, of application Ser. No. 08/296,767 filed Aug. 26, 1994 and now abandoned.

BACKGROUND OF THE INVENTION

1. Field Of The Invention

This invention relates to process sequences for the reduction of fouling in the fractional distillation of light end hydrocarbon components, such as those produced by catalytic cracking, pyrolysis or steam cracking. More particularly, the invention relates to process sequences to reduce fouling by use of upstream hydrogenation unit configurations, rather than the multiple hydrogenation unit configurations used in conventional fractional distillation systems.

2. Background

Steam crackers can operate on light paraffin feeds such as ethane and propane, or on feedstocks which contain propane and heavier compounds to make olefins. Steam cracking these heavier feedstocks produces many marketable products, notably propylene, isobutylene, butadiene, amylene and pyrolytic gasoline.

In addition to the foregoing, small quantities of undesirable contaminants, such as di- and poly-olefins, and acetylinic compounds are produced. These contaminants may also be produced with olefins from catalytic cracking. These contaminants may cause equipment fouling, interfere with polymerization reactions, and in some cases pose safety hazards. It is, therefore, highly desirable to remove them from the cracked stream in the downstream recovery process.

The recovery of the various olefin products from either type of cracked stream is usually carried out by fractional distillation using a series of distillation steps or columns to separate out the various components. The unit which separates hydrocarbons with one carbon atom ($C_1$) and lighter fraction is referred to as the "demethanizer". The unit which separates hydrocarbons from the heavier components with two carbon atoms ($C_2$) from the heavier components is referred to as the "deethanizer". The unit which separates the hydrocarbon fraction with three carbon atoms ($C_3$) from the heavier components is referred to as the "depropanizer". The unit which separates the hydrocarbon fraction with four carbon atoms ($C_4$) is referred to as the "debutanizer." The residual heavier components having a higher carbon number fraction ($C_5$ +) may be used as gasoline or recycled back to into the steam cracker. The various fractionation units may be arranged in a variety of sequences in order to provide desired results based upon various feedstocks. To that end, a sequence which uses the demethanizer first is commonly referred to as the "front-end demeth" sequence. Similarly, when the demethanizer is used first, it is commonly referred to as the "front-end deeth" sequence. And, when the depropanizer is used first, it is commonly referred to as "front-end deprop" sequence.

In all of the sequences, the gases leaving the steam cracker are quenched and have their acid gas removed. At this point, the various flow sequences diverge. In the conventional front-end demethanizer sequence, as illustrated in FIG. 2, the quenched and acid-free gases containing hydrocarbons having one to five or more carbon atoms per molecule ($C_1$ to $C_5$+) first enter a demethanizer, where hydrogen and $C_1$ are removed. This tower operates at very cold temperatures (ie.−300° C.) and therefore has a reduced tendency to foul. The heavy ends exiting the demethanizer, consists of $C_2$ to $C_5$+ molecules. These heavy ends then are routed to a deethanizer where the $C_2$ components are taken over the top and the $C_3$ to $C_5$+ compounds leave as bottoms. The $C_2$ components leaving the top of the deethanizer are fed to an acetylene converter and onto a $C_2$ splitter which produces ethylene as the light product and ethane as the heavy product. The $C_3$ to $C_5$+ stream leaving the bottom of the deethanizer is routed to a depropanizer, which sends the $C_3$ components overhead and the $C_4$ to $C_5$+ components below. The $C_3$ product may be hydrotreated to remove $C_3$ acetylene and diene before being fed to a $C_3$ splitter, where it is separated into propylene at the top and propane at the bottom, while the $C_4$ to $C_5$+ stream is fed to a debutanizer, which produces $C_4$ components at the top with the balance of $C_5$+ components leaving as bottoms to be used for gasoline or to be recirculated into the furnace or cracker as feedstock. Both the $C_4$ and the $C_5$+ streams may be separately hydrotreated to remove undesirable acetylenes and dienes.

In conventional front-end deethanizer sequences, as illustrated in FIG. 3, the quenched and acid free gases containing $C_1$ to $C_5$ + components first enter a deethanizer. The light ends exiting the deethanizer consist of $C_2$ and $C_1$ components along with any hydrogen. These light ends are fed to a demethanizer where the hydrogen and $C_1$ are removed as light ends and the $C_2$ components are removed as heavy ends. The $C_2$ stream leaving the bottom of the demethanizer is fed to an acetylene converter and then to a $C_2$ splitter which produces ethylene as the light product and ethane as the heavy product. The heavy ends exiting the deethanizer which consist of $C_3$ to $C_5$+ components are routed to a depropanizer which sends the $C_3$ components overhead and the $C_4$ to $C_5$ + components below. The $C_3$ product is fed to a $C_3$ splitter where it is separated into propylene at the top and propane at the bottom, while the $C_4$ to $C_5$+ stream is fed to a debutanizer which produces $C_4$ compounds at the top with the balance leaving as bottoms to be used for gasoline or to be recirculated. As with the demethanizer sequence, the $C_3$, $C_4$, and $C_5$+ streams may separately hydrotreated to remove undesirable acetylenes and dienes.

In conventional front-end depropanizer sequences, as illustrated in FIG. 4, the quenched and acid-free gases containing hydrocarbons having from one to five or more carbon atoms per molecule ($C_1$ to $C_5$+) first enter a depropanizer. The heavy ends exiting the depropanizer consist of $C_4$ to $C_5$+ components. These are routed to a debutanizer where the $C_4$'s and lighter species are taken over the top with the rest of the feed leaving as bottoms which can be used for gasoline or other chemical recovery. These steams may be separately hydrotreated to remove undesired acethylenes and dienes. The tops of the depropanizer, containing $C_1$ to $C_3$ components, are fed to an acetylene converter and then to a demethanizer system, where the $C_1$ components and any remaining hydrogen are removed as an overhead. The heavy ends exiting the demethanizer system, which contains $C_2$ and $C_3$ components, are introduced into a deethanizer wherein $C_2$ components are taken off the top and $C_3$ compounds are taken from the bottom. The $C_2$ components are, in turn, fed to a $C_2$ splitter which produces ethylene as the light product and ethane as the heavy product. The $C_3$ stream is fed to a $C_3$ splitter which separates the $C_3$ species, sending propylene to the top and propane to the bottom.

In conventional distillation sequences, as described above, multiple hydrogenation units are used to remove contaminants. The location and complexity of a typical hydrogenation unit is set by the compatibility of process conditions with the catalyst system used and the products being treated. Hydrogenation units required for the production of the aforementioned marketable distillation products include, in addition to the acetylene converter which treats the $C_2$ stream, a methylacetylene/propadiene converter ahead of the $C_3$ splitter to remove contaminants from propylene and propane products and to avoid the risk of detonation in the $C_3$ splitter caused by build-up of methylacetylene and propadiene, a hydrogenation unit ahead of the debutanizer to remove $C_4$ and $C_5$ acetylenes from $C_4$ and $C_5$ olefins, and either a heat soaker or a hydrogenation unit on the debutanizer bottoms to remove additional $C_5$ acetylenes from pyrolysis gasoline. There is, therefore, a requirement of multiple, separate and distinct hydrogenation units. While such a configuration is generally effective to remove contaminants, it is costly. The hydrogenation units required in this configuration are often very similar in nature and often require large recycle loops to moderate the reaction and fractionation facilities to remove excess hydrogen and other gases. Furthermore, since the hydrogenation units are downstream of most the equipment in a steam cracker facility, the equipment, including fractionators, boilers and pumps, are often subject to costly fouling due to the presence of undesired contaminants.

It would be desirable if one could develop a treatment method for fractionating the $C_2$, $C_3$ and $C_4$ hydrocarbon components from a steam cracked hydrocarbon stream which eliminates or reduces fouling in the fractionation units caused by di-olefinically and acetylinically unsaturated hydrocarbon contaminants in the stream without unduly complicating the process sequence or increasing the capital and processing costs of the operation.

SUMMARY OF THE INVENTION

This invention comprises novel processing sequences for treating a cracked hydrocarbon stream which result in the reduction of the quantity of di-olefinically, poly-olefinically and acetylinically unsaturated hydrocarbon contaminants therein which are primarily responsible for fouling of equipment. More specifically, the present invention relates to the placement of a hydrogenation unit on a first unit of the processing sequence, said first unit operating as either a deethanizer or a depropanizer. The hydrogenation unit may be placed to operate on either a side draw or on the bottoms of the first unit. The use of upstream hydrogenation is applicable to front-end demethanizer, front-end deethanizer or front-end depropanizer processing sequences.

As a further advantage of this invention, application of this invention enables the simplification of the processing equipment requirements for units downstream from the first unit. Namely, the need to separately submit to hydrogenation the effluent stream products from the various fractionation towers has been overcome, thereby eliminating the need for multiple hydrogenation units in the overall processing sequence.

This invention discloses novel flow sequences in that fouling is prevented by replacing the conventional multiple hydrogenation unit configuration of fractional distillation flow sequences with an upstream hydrogenation unit configuration which operates in conjunction with an acetylene converter.

The upstream hydrogenation unit configuration of the present invention uses a hydrogenation unit located on either a side draw or in the reboiler circuit of a deethanizer or depropanizer in a front-end demethanizer, front-end deethanizer or a front-end depropanizer sequence for the recovery of various olefin products via fractional distillation.

BRIEF DESCRIPTION OF THE DRAWINGS

The above and other embodiments of the present invention may be more fully understood from the following detailed description, when taken together with accompanying drawings wherein similar reference characters refer to similar elements throughout, and in which.

DESCRIPTION OF THE PREFERRED EMBODIMENTS

The present invention comprises processing sequences for the reduction of fouling in the treatment of a cracked hydrocarbon stream, involving the use of an upstream hydrogenation unit in conjunction with an acetylene converter, rather than the conventional multiple hydrogenation unit configurations.

Figure 1B:
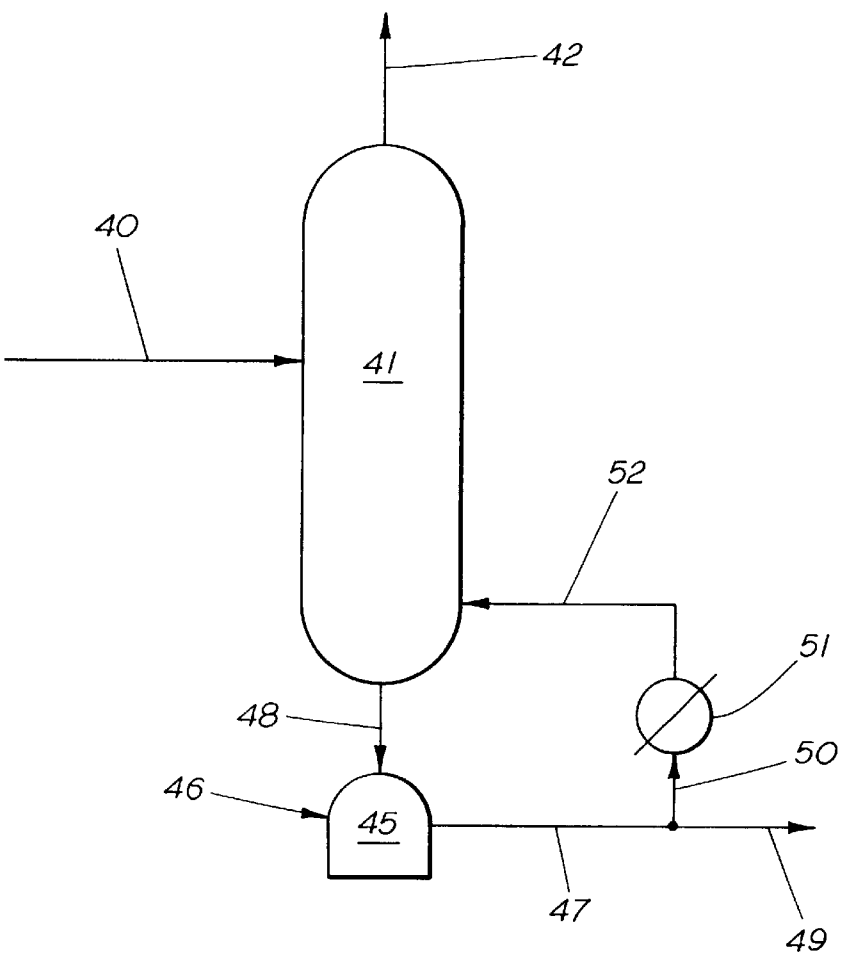
FIG. 1 is a flow diagram of a portion of the process for the separation of cracked hydrocarbons of the present invention featuring, in FIG. 1A, a hydrogenation unit operating on a side liquid draw, and in FIG. 1B, a hydrogenation unit operating in a reboiler circuit.
Figure 1A:
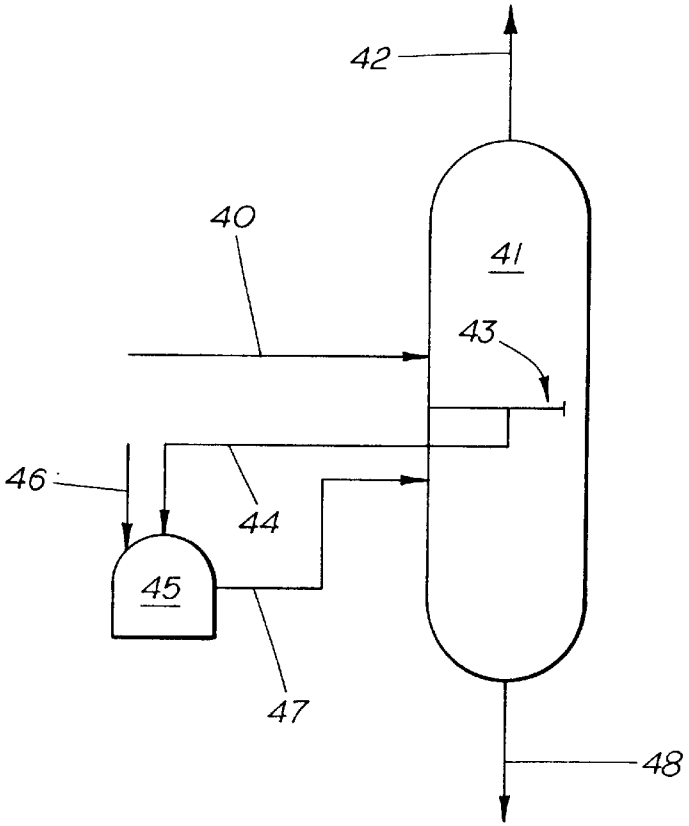

FIG. 1 and the subsequent discussion describes, without in any way limiting the scope of the present invention, alternative embodiments, namely flow diagrams of a portion of the process for the separation of cracked hydrocarbons depicting the use of a hydrogenation unit operating on a side liquid draw, FIG. 1A, and a hydrogenation unit operating in a reboiler circuit, FIG. 1B.

In FIG. 1A, a feedstock 40 which may consist of a quenched, acid-free hydrocarbon stream containing either a full $C_1$ to $C_5$+ component stream or a $C_2$ to $C_5$+ stream, is fed to a first unit 41. The feedstock 40 is fractionated in the first unit 41 into a tops stream 42 and a bottoms stream 48. At an intermediate step in the fractionation, a collection tray 43 collects components in a liquid phase. These liquid components are removed from the first unit 41 through a side liquid draw 44 and are fed to a hydrogenation unit 45 wherein the side liquid draw 44 material is reacted with hydrogen 46 under conditions of temperature, pressure and over a catalyst selective for the hydrogenation of the di-olefinic, poly-olefinic and acetylinic contaminants contained therein. The source of hydrogen 46 may be either from a high purity hydrogen source or from recycled gas obtained from the pyrolysis effluent which contains sufficient levels of hydrogen for efficient hydrogenation to take place, thereby eliminating the expense associated with the high purity hydrogen source.

The heavy components and oligomers which result from hydrogenation of the aforementioned contaminants and which have not been converted to olefins are commonly referred to as "green oil." The "green oil" components are non-fouling with regards to their passage through subsequent processing units. Following the hydrogenation, the so-hydrogenated stream leaving the hydrogenation unit 45 may optionally be treated to remove excess hydrogen by first contacting it with a nonselective reactive catalyst bed (not illustrated).

The so-hydrogenated stream 47 is fed back to the first unit where the stream is further fractionated and the heavy fraction, which has been hydrogenated, leaves as bottoms 48. The bottoms stream 48 may be further treated in a depropanizer (not illustrated) to separate the $C_3$ compounds from the $C_4$ and $C_5$+ compounds, depending upon which sequence is being utilized. In any event, the bottoms streams 48 is eventually fed to a second unit (not illustrated) which serves as a debutanizer to separate the $C_4$ compounds from the $C_5$ + compounds.

In the above described embodiment, the hydrogenation unit of the present invention may be located at a side liquid draw of either a deethanizer, in a front-end demethanizer sequence or front-end deethanizer sequence, or a depropanizer, in a front-end depropanizer sequence. Alternatively, the side draw may be of a gaseous phase or may be of a mixed phase.

Placing the hydrogenation unit at the side liquid draw is advantageous in comparison to the use of multiple hydrogenation units downstream are removed prior to getting to the high temperature zone of the first unit. As a result, the hydrogenation unit at this location reduces fouling both in the first unit and in its accompanying reboiler circuit. Additionally, another benefit of this location is that the need for a recycle stream, which is typically required to insure that the concentration of contaminants into the hydrogenation unit be of sufficiently low concentration, may be eliminated as the reboiler circuit rate can be adjusted to serve this purpose.

Still another benefit of the side draw location is that the excess hydrogen required to operate the hydrogenation unit goes to the first unit where it is removed overhead. This eliminates the need for separate hydrogen removal facilities which are required for the multiple hydrogenation unit configurations.

An alternative embodiment is depicted in FIG. 1B in which a feedstock 40 which may consist of a quenched, acid free hydrocarbon stream containing either a full complement of $C_1$ to $C_5$ + components or a $C_2$ to $C_5$ + stream, is fed to a first unit 41.

The feedstock 40 is routed to a first unit 41 where the top stream 42 is taken over the top and the bottom stream 48 leaves out the bottoim The heavy stream 48 leaving the bottom of the first unit 41 in addition to containing desirable product components such as isobutylene, butadiene, amylene and pyrolytic gasoline, also contains as undesirable contaminants, which produce fouling of the downstream units, di-olefinic, poly-olefinic and acetylinic compounds such as methylacetylene and propadiene.

In accordance with this embodiment of the present invention, the heavy stream 48 leaving the bottom of the first unit 41 is fed to a hydrogenation unit 45 wherein the heavy stream 48 is reacted with hydrogen 46 under conditions of temperature, pressure and over a catalyst selective for the hydrogenation of the di-olefinic, poly-olefinic and acetylinic contaminants contained therein. The source of hydrogen 46 may be either from a high purity hydrogen source or from tail gas obtained from the pyrolysis effluent which contains sufficient levels of hydrogen for efficient hydrogenation to take place, thereby eliminating the expense associated with the high purity hydrogen source. The heavy components and oligomers which result from hydrogenation of such contaminants and which have not been converted to olefins are commonly referred to as "green oil." The "green oil" components are non-fouling with regards to their passage through subsequent processing units. Following the hydrogenation reaction, the so hydrogenated stream 47 leaving the hydrogenation unit 45 may be treated to remove excess hydrogen by first contacting it with a nonselective reactive catalyst bed (not illustrated) and this product or the hydrogenated product stream may be split into a first and second portion 50 and 49. The first portion of the hydrogenated product stream 50 is fed to reboiler 51 and is heated to a temperature of from about 50° to about 150° C. at a pressure of from about 1000 to about 3000 kPa and then returned by line 52 to the bottom of the first unit 41.

The bottoms stream 49 may be further treated in a depropanizer (not illustrated) to separate the $C_3$ compounds from the $C_4$ and $C_5$ compounds, depending upon which sequence is being utilized. In any event, the bottoms stream 49 is eventually fed to a second unit (not illustrated) which serves as a debutanizer to separate the $C_4$ compounds from the $C_5$+ compounds.

In the above described embodiment, the hydrogenation unit of the present invention may be located in the reboiler circuit of either a deethanizer, in a front-end demethanizer sequence or a front-end deethanizer sequence, or a depropanizer, in a front-end depropanizer sequence. Placing the hydrogenation unit in one of the above referenced locations is advantageous in comparison to the use of multiple hydrogenation units downstream because it optimizes the defouling performance of the hydrogenation unit since the bulk of the fouling contaminants are concentrated in the reboiler circuit. Additionally, location of the hydrogenation unit at this location reduces fouling in the reboiler circuit of the first unit. Yet another benefit of this location is that the need for the standard hydrogenation feed pump, which is employed to insure that the feed to the hydrogenation unit is in liquid form is eliminated. The recycle stream, which is typically required to insure that the concentration of contaminants into the hydrogenation unit be of sufficiently low concentration, may be eliminated as the reboiler circuit rate can be adjusted to serve this purpose.

The alternative embodiments depicted in FIGS. 1A and 1B may be employed in conjunction with a variety of alternative sequences, namely a front-end demethanizer, front-end deethanizer or front-end deproparizer sequences. The optional location of the upstream hydrogenation unit, or side draw or reboiler unit, ultimately depend based upon the particular sequence employed and the given set of operating conditions.

Figure 2:
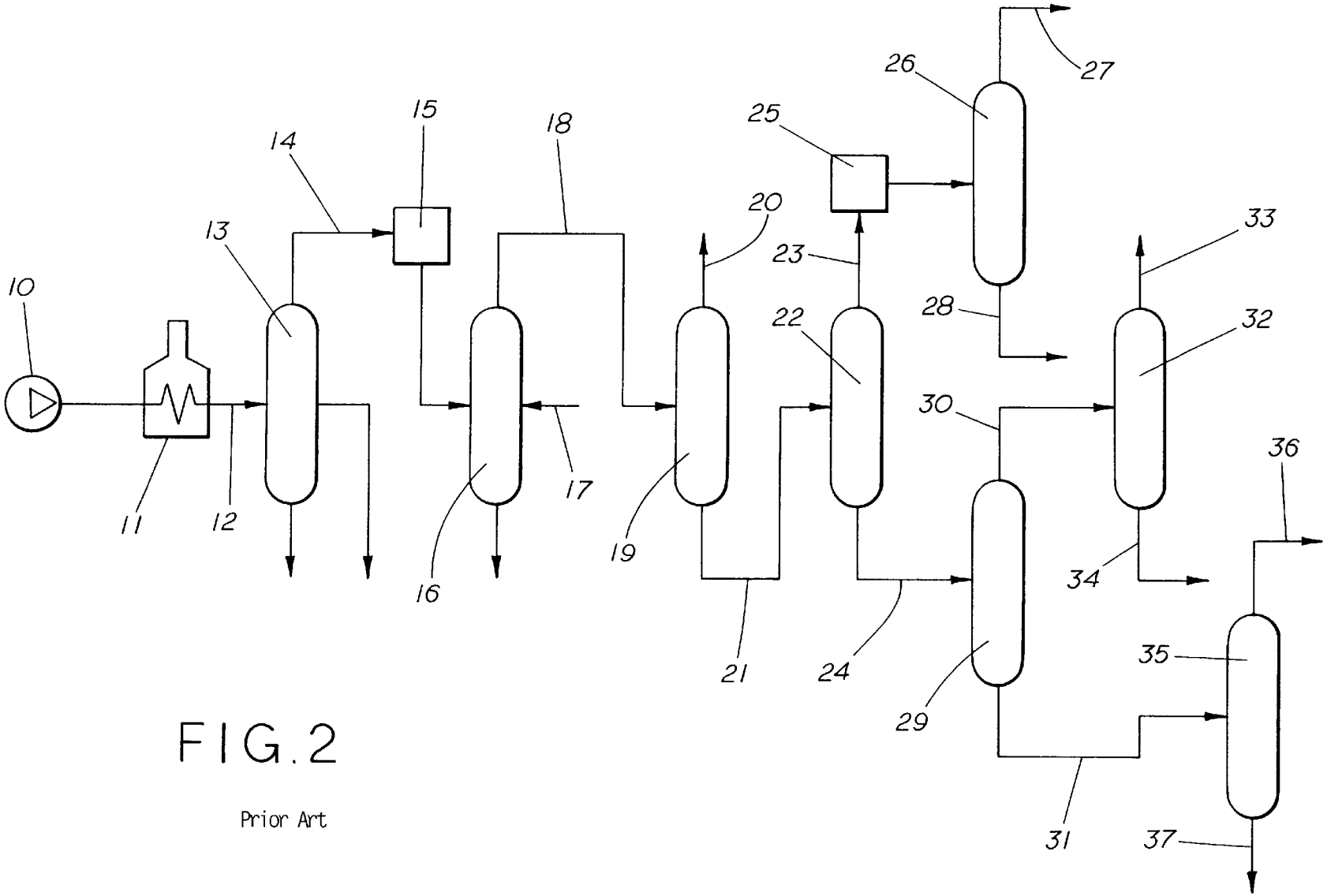
FIG. 2 Prior Art
FIG. 2 is a flow diagram of the conventional front-end demethanizer process for the separation of cracked hydrocarbons.
Figure 3:
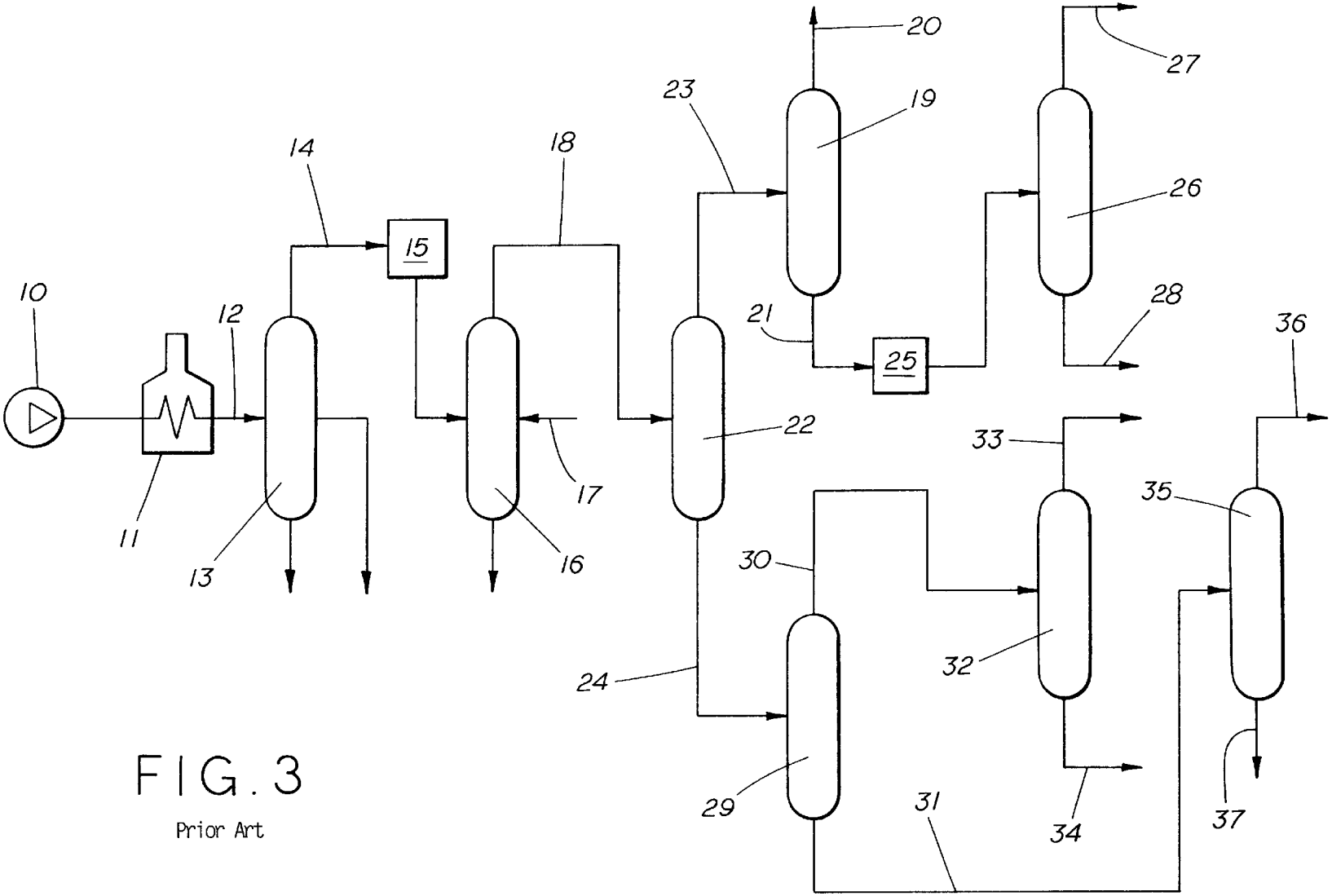
FIG. 3 Prior Art
FIG. 3 is a flow diagram of the conventional front-end deethanizer process for the separation of cracked hydrocarbons.
Figure 4:
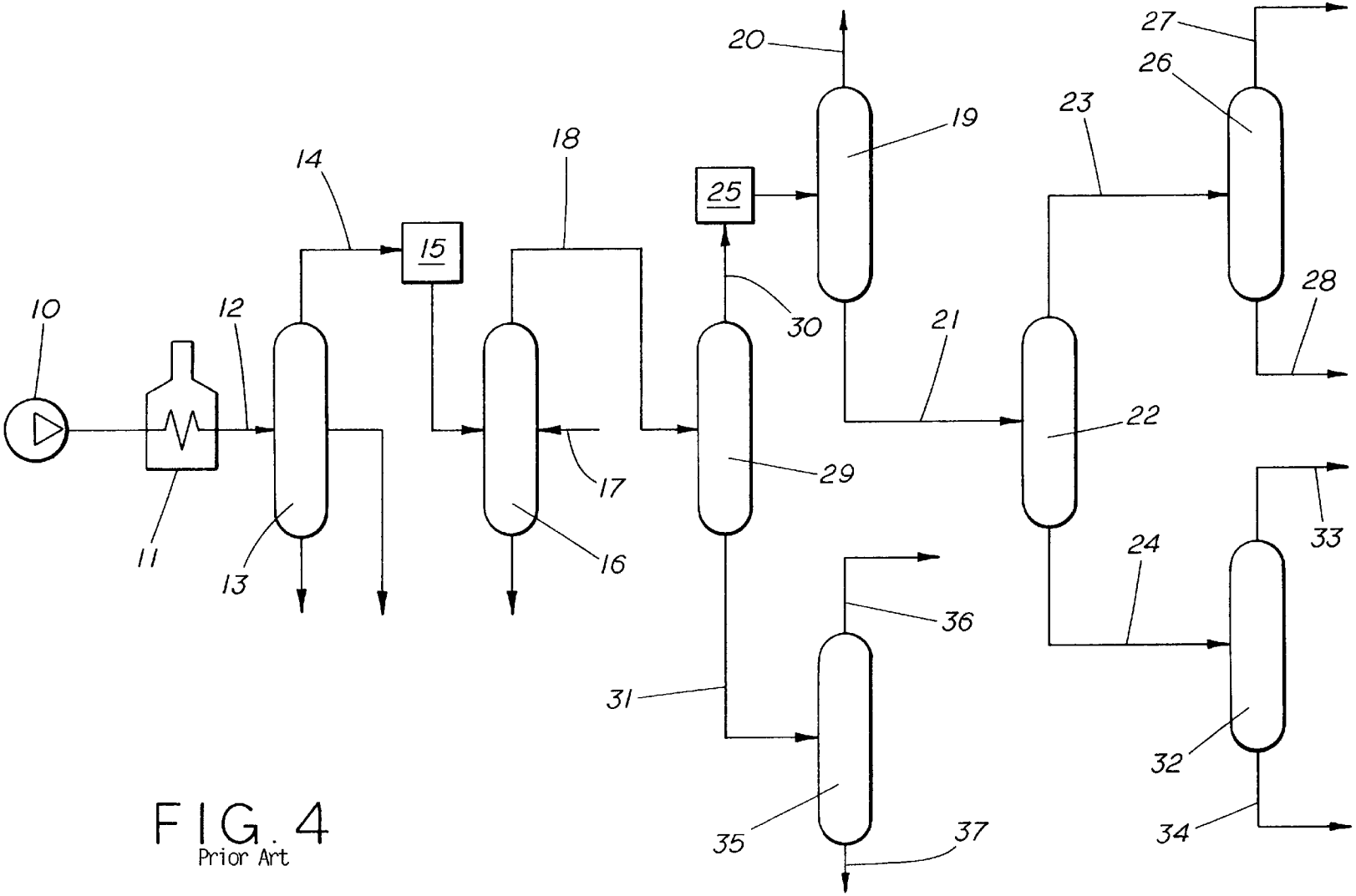
FIG. 4 Prior Art
FIG. 4 is a flow diagram of the conventional front-end depropanizer process for the separation of cracked hydrocarbons.

FIGS. 2, 3 and 4 depict a front-end demethanizer sequence, a front-end deethanizer sequence and a front-end depropanizer sequence respectively. In any of these sequences feedstock 10 consisting of hydrocarbons, such as ethane, propane, butane, naphtha, or gas oil or mixtures thereof is introduced into a pyrolytic oven 11 where feedstock 10 is pyrolyzed to form a mixture of products. The pyrolyzed gases 12 leaving the pyrolytic oven 11 are quenched in a quench vessel 13 to arrest undesirable secondary reactions which tend to destroy light olefins. The quenched gases 14 are then compressed in a compressor 15. The compressed gases are fed to an acid gas removal vessel 16 where they undergo acid gas removal, typically with the addition of a base such as NaOH 17. At this point, the gas 18 contains hydrogen and hydrocarbons having from one to five or more carbon atoms per molecule ($C_1$ to $C_5$+) and the aforementioned sequences diverge.

In the case of a front-demethanizer sequence as depicted in FIG. 2, the gas 18 is fed to a demethanizer 19 wherein the $C_1$ fraction containing methane and any hydrogen 20 is removed. The bottoms stream 21 exiting the demethanizer 19 consists of the $C_2$ to $C_5$+ species. These are routed to a deethanizer 22 where the light stream 23 containing $C_2$ components is taken over the top and the heavy stream 24 containing $C_3$ to $C_5$ + components leaves out the bottom. The deethanizer 22 may be configured as the first unit 41 is depicted in either embodiment of FIG. 1. The deethanizer 22 may therefore have a side liquid draw 44 which is fed to a hydrogenation unit 45 or alternatively the heavy stream 24 exiting as bottoms from the deethanizer 22 may be fed to a hydrogenation unit 45 in the reboiler circuit of the deethanizer 22. The light stream 23 leaving the deethanizer 22 is fed to an acetylene converter 25, and then is fed to a $C_2$ splitter or fractionator 26 which produces ethylene 27 as the light product and ethane 28 as the heavy product. The $C_3$ to $C_5$ + stream 24 leaving the bottom of the deethanizer 22 is fed into a depropanizer 29 which sends the light stream 30 containing the $C_3$ components overhead and the $C_4$ to $C_5$ + species 31 below. The light stream 30 may be fed into a splitter 32 to separate the $C_3$ stream into propylene 33 at the top and propane 34 at the bottom, while the $C_4$ to $C_5$+ stream 31 is fed to a debutanizer 35, the second unit referenced but not illustrated in the discussion of either embodiment of FIG. 1, which produces the $C_4$ species at the top 36 with the $C_5$ + species leaving as bottoms 37 to be used as pyrolytic gasoline or recirculated into the pyrolytic oven.

In the case of a front-end deethanizer sequence, as depicted in FIG. 3, the gas 18 is fed to a deethanizer 22 where the light stream 23 containing hydrogen, $C_1$ and $C_2$ components is taken over the top and the heavy stream 24 containing $C_3$ to $C_5$ + components leaves out the bottom. The deethanizer 22 may be configured as the first unit 41 is depicted in either embodiment of FIG. 1. The deethanizer 22 may therefore have a side liquid draw 44 which is fed to a hydrogenation unit 45 or alternatively the heavy stream 24 exiting as bottoms from the deethanizer 22 may be fed to a hydrogenation unit 45 in the reboiler circuit of the deethanizer 22. The light stream 23 leaving the deethanizer 22 is fed to a demethanizer 19 where the $C_1$ fraction containing methane and any hydrogen 20 is removed. The bottoms stream 21 is fed to an acetylene converter 25, and then is fed to a $C_2$ splitter or fractionator 26 which produces ethylene 27 as the light product and ethane 28 as the heavy product. The heavy stream 24 exiting as bottoms from the deethanizer 22 is fed into a depropanizer 29 which sends the light stream 30 containing the $C_3$ components overhead and the $C_4$ to $C_5$ + species 31 below. The light stream 30 may be fed into a splitter 32 to separate the $C_3$ stream into propylene 33 at the top and propane 34 at the bottom, while the $C_4$ to $C_5$+ stream 31 is fed to a debutanizer 35, the second unit referenced but not illustrated in the discussion of either embodiment of FIG. 1, which produces the $C_4$ species of the top 36 with the $C_5$+ species leaving as bottoms 37 to be used as pyrolytic gasoline or recirculated into the pyrolytic oven.

In the case of a front-end depropanizer sequence, as depicted in FIG. 4, the gas 18 is fed to a depropanizer 29 where the light stream 30 containing hydrogen and the $C_1$ to $C_3$ components leaves overhead and the $C_4$ to $C_5$ + species 31 exit below. The depropanizer 29 may be configured as the first unit 41 is depicted in either embodiment of FIG. 1. The depropanizer 29 may therefore have a side liquid draw 44 which is fed to a hydrogenation unit 45 or alternatively the $C_4$ to $C_5$+ species 31 exiting as bottoms from the depropanizer may be fed a hydrogenation unit 45 in the reboiler circuit of the depropanizer 29. The light stream 30 leaving the depropanizer 29 is fed to an acetylene converter 25, and then is fed to a demethanizer 19 wherein the $C_1$ fraction containing methane and any hydrogen 20 is removed. The bottom stream 21 exiting the demethanizer 19 consists of the $C_2$ to $C_3$ species. These are routed to a deethanizer 22 were the light stream 23 containing $C_2$ components is taken over the top and the heavy stream 24 containing the $C_3$ species leaves out the bottom. The light stream 23 may be fed to a $C_2$ splitter or fractionator 26 which produces ethylene 27 as the light product and ethane 28 as the heavy product. The heavy stream 24 may be fed into splitter 32 to separate the $C_3$ stream into propylene 33 at the top and propane 34 at the bottom.

The $C_4$ to $C_5$ + species 31 exiting the depropanizer 29 is fed to a debutanizer 35, the second unit referenced but not illustrated in the discussion of either embodiment of FIG. 1, which produced the $C_4$ species at the top 36 with the $C_5$+ species leaving as bottoms 37 to be used as pyrolytic gasoline or recirculated into the pyrolytic oven.

As discussed above, the hydrogenation unit of the invention may be placed at either a side draw or in the reboiler circuit of either a deethanizer or a depropanizer. These locations reduce fouling of the hydrogenation unit and the towers and many of the subsequent, conventionally used hydrogenation units.

In the case of the embodiment wherein the hydrogenation unit is used in association with a deethanizer, the two sequences which represent embodiments of the invention are the front-end demethanizer sequence and the front-end deethanizer sequence. Location of the hydrogenation unit upstream of the demethanizer, in the front-end demethanizer sequence, is not practical due to the low temperature of operation of that column and the restricted temperature ranges at which available hydrogenation catalysts operate, generally from about 5° to about 50° C. Location upstream of either the deethanizer or depropanizer, in the front-end deethanizer sequence or front-end depropanizer sequence respectively, is not practical since present hydrogenation conditions which optimize conversion of $C_2$ contaminants would affect the yield of heavier olefins, such as, for example, conversion of propylene to propane. It is preferred, therefore, that the feedstock which is hydrogenated in the hydrogenation unit of the invention consist primarily of $C_3$, $C_4$, and $C_5$ + species or components species thereof.

In the case of the embodiment wherein hydrogenation takes place in association with a deethanizer, that hydrogenation unit will be fed a mixture $C_3$ to $C_5$ + species. In the case of the embodiment wherein the hydrogenation takes place in association with a depropanizer, that hydrogenation unit will be fed a mixture of $C_3$ to $C_5$ + species where the feed is from the side draw or a mixture of $C_4$ to $C_5$ + species where the feed is in the reboiler circuit.

Given the narrow temperature range over which the desired hydrogenation will occur and undesired reactions are minimized, heat liberated during the hydrogenation is often enough to exceed the temperature range so the hydrogenation unit may require a recycle of product to dilute the reacting components and thus moderate the rise in temperature. Such a recycle may be easily accommodated by the reboiler circuit. Some of the heat generated by the reaction may be used to aid in the reboiling.

The catalysts used in the hydrogenation unit are supported catalysts. The supports may be standard, inert supports such as, for example, alumina, silica and the like. The active ingredient of the catalyst used in the hydrogenation unit of the invention consists of, for example, palladium. In a preferred embodiment, enhancers are used to optimize operation of the hydrogenation unit. Such enhancers include gold, silver, vanadium and the like. These catalysts may also be used as the catalyst in the above referenced nonselective catalyst bed.

EXAMPLES

To illustrate the advantage of one embodiment of the invention over the prior art, a computer simulation was run as an example. This case is for the depropanizer first sequence. Case I illustrates the prior art as a comparative example and Case II illustrates one of the embodiments in which a side liquid draw on the depropanizer is utilized. Both cases have equivalent fouling rates as measured by tower run length.

CASE I.
WITHOUT INVENTION

| COMPONENT FLOW RATE, LB/HR | DEPROP FEED | DEPROP OVHD | DEPROP BTMS |
|---|---|---|---|
| C2's and lighter | 316,043 | 316,043 | 0 |
| Propane | 11,936 | 11,936 | 0 |
| Propylene | 58,407 | 58,407 | 0 |
| MAPD | 3,006 | 2,986 | 20 |
| C4 Paraffins | 6,652 | 10 | 6,642 |
| C4 Olefins | 6,515 | 1 | 6,514 |
| Butadiene | 177,681 | 1 | 17,767 |
| C4 Acetylenes | 1,731 | 0 | 1,731 |
| C5's and heavier | 33,440 | 0 | 33,440 |
| Total | 455,498 | 389,384 | 66,114 |
| Temp, ° F. | | −40 | 160 |
| Pressure, psig | | 150 | 685 |

CASE II.
WITH INVENTION

| COMPONENT FLOW RATE, LB/HR | DEPROP FEED | DEPROP OVHD | DEPROP BTMS |
|---|---|---|---|
| C2's and lighter | 316,043 | 316,228 | 0 |
| Propane | 11,936 | 11,933 | 3 |
| Propylene | 58,407 | 60,445 | 1 |
| MAPD | 3,006 | 1,160 | 16 |
| C4 Paraffins | 6,652 | 0 | 6,652 |
| C4 Olefins | 6,515 | 0 | 6,652 |
| Butadiene | 177,681 | 0 | 16,950 |
| C4 Acetylenes | 1,731 | 0 | 220 |
| C5's and heavier | 33,440 | 0 | 33,440 |
| Total | 455,498 | 389,766 | 66,037 |
| Temp, ° F. | | −41 | 225 |
| Pressure, psig | | 150 | 1585 |

One can see from the data that one can operate at a much higher depropanizer pressure (1585 psig) and higher temperature (225°F.) with this embodiment vs. the comparative example (685 psig and 160 °F.) which results in equivalent fouling or the same tower run length. In an operating facility one would actually operate at the lower pressure and temperature conditions to achieve a much longer tower run length.

Benefits are also seen in the downstream debutanizer. In Case I, the debutanizer runs at 10 psig, while for Case II, debutanizer runs at 37 psig (and therefore higher temperatures) with an equivalent fouling rate.

From this description of preferred embodiments, those skilled in the art may find many variations and adaptations thereof, and all such variations and adaptations, falling within the scope and spirit of the invention, are intended to be covered by the claims hereafter.

We claim:

1. A process to reduce equipment fouling in the fractionation of mixtures of a cracked hydrocarbon stream by sequential fractional distillation, comprising the steps of:

(a) feeding to a first unit a feedstock containing at least a $C_2$ to $C_5^+$ fraction of the cracked hydrocarbon stream;

(b) removing from said first unit a stream enriched in at least a $C_4$ to $C_5^+$ fraction;

(c) reacting the stream enriched in said at least the $C_4$ to $C_5^+$ fraction with hydrogen under conditions effective to selectively hydrogenate di-olefinically, poly-olefinically and acetylinically unsaturated hydrocarbon components to olefins, oligomers and heavy components. to produce a hydrogenated stream;

(d) returning at least a portion of the hydrogenated stream produced in step (c) to said first unit.

2. A process as in claim 1, further comprising the step of:

(e) ultimately treating at least a portion of the hydrogenated stream produced in step (c) in a second unit to split the $C_4$ species from the $C_5^+$ species.

3. The process of claim 2, wherein the removing of the enriched in at least the $C_4$ to $C_5$+ fraction is accomplished by using the process of a side liquid draw.

4. The process of claim 2, wherein the removing of the enriched in at least the $C_4$ to $C_5$+ fraction is accomplished by using the bottoms stream from said first unit.

5. The process of claim 3, wherein the first unit is a deethanizer.

6. The process of claim 4, wherein the first unit is a deethanizer.

7. A process as in claim 5, wherein said cracked hydrocarbon stream is first fed to a demethanizer upstream of said first unit wherein said cracked hydrocarbon stream is fractionated into a light stream and a heavy stream and said heavy stream is fed to said first unit.

8. A process as in claim 6, wherein said cracked hydrocarbon stream is first fed to a demethanizer upstream of said first unit wherein said cracked hydrocarbon stream is fractionated into a light stream and a heavy stream and said heavy stream is fed to said first unit.

9. A process as in claim 5, wherein said hydrogenated stream is fed to a depropanizer located between said first unit and said second unit and the $C_3$ fraction is separated from the $C_4$ to $C_5$+ fraction.

10. A process as in claim 6, wherein said hydrogenated stream is fed to a depropanizer located between said first unit and said second unit and the $C_3$ fraction is separated from the $C_4$ to $C_5$+ fraction.

11. A process as in claim 7, wherein said hydrogenated stream is fed to a depropanizer located between said first unit and said second unit and the $C_3$ fraction is separated from the $C_4$ to $C_5$+ fraction.

12. A process as in claim 8, wherein said hydrogenated stream is fed to a depropanizer located between said first unit and said second unit and the $C_3$ fraction is separated from the $C_4$ to $C_5$+ fraction.

13. The process of claim 3, wherein the first unit is a depropanizer and the hydrogen and $C_1$ to $C_3$ fraction is separated from the $C_4$ to $C_5$+ fraction.

14. The process of claim 4, wherein the first unit is a depropanizer and the hydrogen and $C_1$ to $C_3$ fraction is separated from the $C_4$ to $C_5$ + fraction.

15. A process as in claim 13 further comprising the step of separating the hydrogen and $C_1$ to $C_3$ fraction into individual $C_1$ hydrocarbon, $C_2$ hydrocarbon and $C_3$ hydrocarbon component streams.

16. A process as in claim 14, further comprising the step of separating the hydrogen and $C_1$ to $C_3$fraction into individual $C_1$ hydrocarbon and hydrogen, $C_2$hydrocarbon, and $C_3$ hydrocarbon component streams.

17. A process as in claim 1, further comprising the step of removing excess hydrogen from the hydrogenated stream produced by step (c).

18. The process of claim 17, wherein the hydrogen is removed by passing the hydrogenated stream into contact with a nonselective reactive catalyst bed.

* * * * *